US007383784B2

(12) United States Patent
Eilertsen

(10) Patent No.: US 7,383,784 B2
(45) Date of Patent: Jun. 10, 2008

(54) LASHING OF TENDER ASSIST DRILLING UNIT TO A FLOATING PRODUCTION FACILITY

(75) Inventor: Terje W. Eilertsen, Houston, TX (US)

(73) Assignee: Technip France, Courbevoie (FR)

( * ) Notice: Subject to any disclaimer, the term of this patent is extended or adjusted under 35 U.S.C. 154(b) by 371 days.

(21) Appl. No.: 11/332,280

(22) Filed: Jan. 13, 2006

(65) Prior Publication Data

US 2007/0119359 A1 May 31, 2007

Related U.S. Application Data

(60) Provisional application No. 60/740,748, filed on Nov. 30, 2005.

(51) Int. Cl.
*B63B 21/00* (2006.01)

(52) U.S. Cl. ..... 114/230.2

(58) Field of Classification Search ..... 405/224; 114/230.2–230.27, 293; 414/137.9–138.4
See application file for complete search history.

(56) References Cited

U.S. PATENT DOCUMENTS

| | | | | |
|---|---|---|---|---|
| 4,200,052 | A * | 4/1980 | Cunningham et al. | 114/230.21 |
| 4,476,801 | A | 10/1984 | Foster et al. | |
| 4,666,127 | A * | 5/1987 | Allen | 254/281 |
| 2003/0159638 | A1 | 8/2003 | Lay et al. | |

FOREIGN PATENT DOCUMENTS

| | | |
|---|---|---|
| FR | 2576577 | 8/1986 |
| GB | 2139977 | 11/1984 |
| WO | WO02/087959 | 11/2002 |
| WO | WO03/062042 | 7/2003 |

OTHER PUBLICATIONS

International Search Report on corresponding PCT application (PCT/US2006/061247) from International Searching Authority (EPO) dated Oct. 18, 2007.
Written Opinion on corresponding PCT application (PCT/US2006/061247) from International Searching Authority (EPO) dated Oct. 18, 2007.

* cited by examiner

*Primary Examiner*—Ed Swinehart
(74) *Attorney, Agent, or Firm*—Klein, O'Neill & Singh, LLP; Howard J. Klein

(57) ABSTRACT

A system for lashing a tender assist drilling unit (TADU) to a floating production platform includes a plurality of winches on the forward end of the TADU, a plurality of sheaves on the upper portion of the hull of the platform, a plurality of connection devices on the lower portion of the hull of the platform, and a set of lashing lines, each of which extends from one of the winches, through a corresponding one of the sheaves, and vertically down alongside the platform hull to a corresponding one of the connection devices to which it is attached. The winches are operable to reel in and to pay out the lashing lines to control the separation distance so as to maintain an optimal operational separation distance during normal environmental conditions, while allowing the separation distance to be increased in severe conditions.

20 Claims, 4 Drawing Sheets

LASHING OF TENDER ASSIST DRILLING UNIT TO A FLOATING PRODUCTION FACILITY

CROSS-REFERENCE TO RELATED APPLICATION

This application claims the benefit, under 35 U.S.C. §119(e), of co-pending provisional application No. 60/740,748, filed Nov. 30, 2005, the disclosure of which is expressly incorporated herein by reference in its entirety.

FEDERALLY SPONSORED RESEARCH OR DEVELOPMENT

Not Applicable

BACKGROUND OF THE INVENTION

The present invention relates to the field of floating offshore structures for the drilling and production of offshore deposits of petroleum and natural gas. In particular, it relates to a system for securing two floating structures together, one of which is a floating production facility kept in position by its own mooring/station-keeping system, and the other being a tender-assist drilling unit (TADU) partly moored to the seabed by at least four aft mooring lines, with the forward part thereof being coupled to the production unit by a set of lashing lines. The result is a coupled station-keeping system for the two floating structures.

In many deepwater drilling and production installations, a floating tender assist drilling unit (TADU) is tied to an adjacent offshore production facility or platform to assist in the drilling and production operations. The TADU can be any type of semi-submersible or barge hull form. Both the TADU and the platform are typically moored to the seabed, and they are lashed to each other so as to restrict relative movement between the two structures, thereby to facilitate the transfer of drilling consumables and personnel from one structure to the other and hook-up of control and fluid lines between the two structures. In the current state of the art, a semi-submersible TADU is moored with a minimum of eight mooring lines in addition to the mooring/station-keeping system of the production facility, which may be a Spar or tensions-leg platform (TLP). Current lashing systems are based on connecting the two floating structures with a pair of lashing lines to control the separation distance and the low and average frequency motions. In a typical coupling system, a number of mooring lines will cross, complicating the seabed layout. Furthermore, meeting critical performance criteria, as explained below, has proven difficult in practice.

In a practical TADU-to-production facility coupling or lashing system, the lashing mechanism must be capable of maintaining the relative movement within predefined limits that allow normal operation throughout environmental conditions that can be expected during the course of a normal year (a "one-year environment"), and that allow limited operations, including the maintenance of drilling circulation and control, throughout worst-case conditions to be expected during a typical ten-year period (a "ten-year environment"). In a 100-year extreme weather condition, the system must be capable of increasing the separation between the structures to a storm-safe distance, and at the same time function as 100-year storm-safe coupled mooring system.

The lashing system must also be capable of maintaining an optimum distance between the two structures during normal operations, while relative motions between them are absorbed. When necessary, the lashing system must allow distance between the two structures to be controllably increased, while maintaining the linkage between them. Thus, it is important, that the lashing system have a relatively low stiffness, so that there is relatively little coupling of the motions between TADU and the platform. Optimally, the lashing system will act as a pre-tensioned spring between the two structures, wherein the spring constant is such that the combination of maximum tension load and restriction in relative motion can assure drilling operability for a one-year environment, and at least a limited operability for a ten-year environment. Furthermore, the lashing system should minimize yaw.

To date, there is an unfulfilled need for a system for lashing together two floating structures that satisfactorily meets criteria set forth above.

SUMMARY OF THE INVENTION

Broadly, the present invention is a system for lashing a first floating structure, such as a TADU, to a second floating structure, such as a production platform, comprising a set of lashing lines, each of which extends from a winch on the first structure, through a sheave on the upper portion of the second structure, then vertically down the hull of the second structure to a connection device, such as a padeye connection, on the lower portion of the hull of the second structure. In the context of an application in which the first structure is a TADU and the second structure is a platform, the set of lashing lines preferably comprises a set of four lashing lines, each of which extends from a winch on the forward part of the TADU, through an idler sheave on the upper portion of the hull of the platform, then vertically down the side of the platform hull to a connection device on the lower portion of the hull. If the platform is a truss-spar type of platform, the upper portion of the hull is a buoyant "hard" tank, on top of which is supported one or more decks. The lower portion of the hull is a truss structure, comprising vertical truss members and diagonal cross-braces. A variable buoyancy "soft" tank is attached to the bottom of the truss structure. In the truss-spar application, each of the idler sheaves is fixed to the hard tank, while the lashing lines extend vertically down the truss structure to the connection devices, each of which is located on a vertical truss member above the soft tank.

In a preferred embodiment, each of the lashing lines comprises a flexible hawser connected at a first or upper end to a free end of a winch cable that is wound on a winch on the first structure or TADU. The flexible hawser is preferably of nylon or a suitable equivalent polymer, while the winch cable is preferable a wire rope cable. The hawser has a lower eyelet fixed to an associated padeye connection, and an upper eyelet attached to a shackle on the free end of the winch cable. The winch cable may comprise first and second sections, connected by suitable connection means, with the first section terminating in the free end to which the hawser is connected, and the second section being wound on, and paid out from, a winch on the TADU.

As will be more fully appreciated from the detailed description that follows, the lashing system of the present invention allows an optimum operating distance to be maintained between the two floating structures, owing to the elasticity of the hawser and the ability to adjust the length of each of the hawser assemblies individually, by means of the winches on the first structure (e.g., the TADU). This adjustability is enhanced by providing the hawsers with a substantial length extending vertically down the hull of the second structure, which provides sufficient length to make significant adjustments. Furthermore, by selecting the stiffness and elasticity of the hawser, the appropriate spring constant can be provided by the hawsers, such that the combination of maximum tension load and restriction in relative motion between the two structures can assure normal drilling operability for a one-year environment, with minimal yaw, and at least a limited operability for a ten-year environment. In addition, the separation distance between the two structures can be increased to a storm-safe distance in 100-year extreme weather conditions, while at the same time the system operates as a 100-year storm-safe coupled mooring system. This result is achieved by having the lashing lines connected to the TADU forward winches for separation control during storm conditions, and for return to the normal operational separation distance during less severe or normal weather conditions.

DETAILED DESCRIPTION OF THE INVENTION

Figure 1:
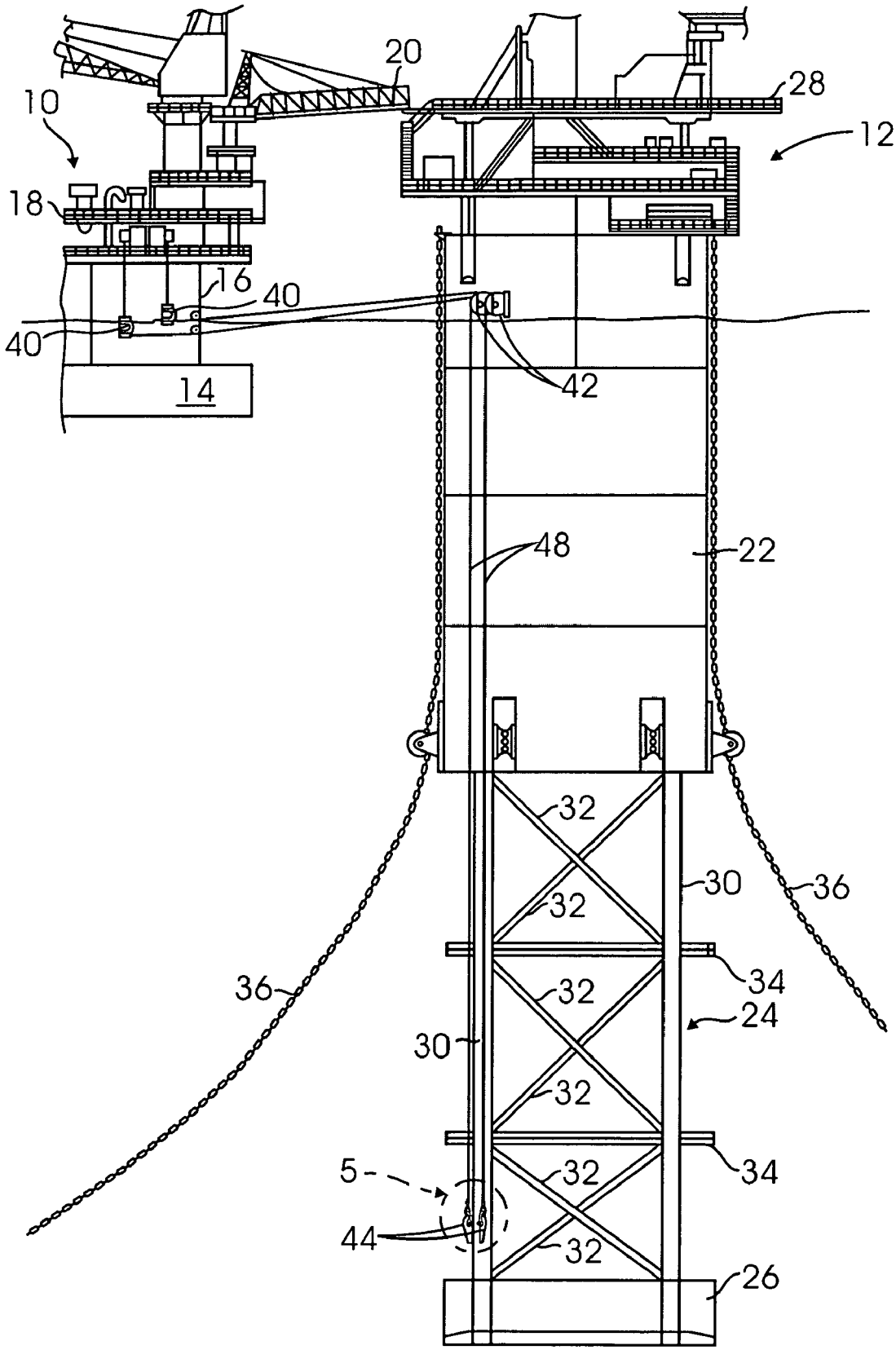
FIG. 1 is an elevational view of a tender assist drilling unit (TADU) and a truss spar-type floating platform linked together by a lashing system in accordance with the present invention.
Figure 2:
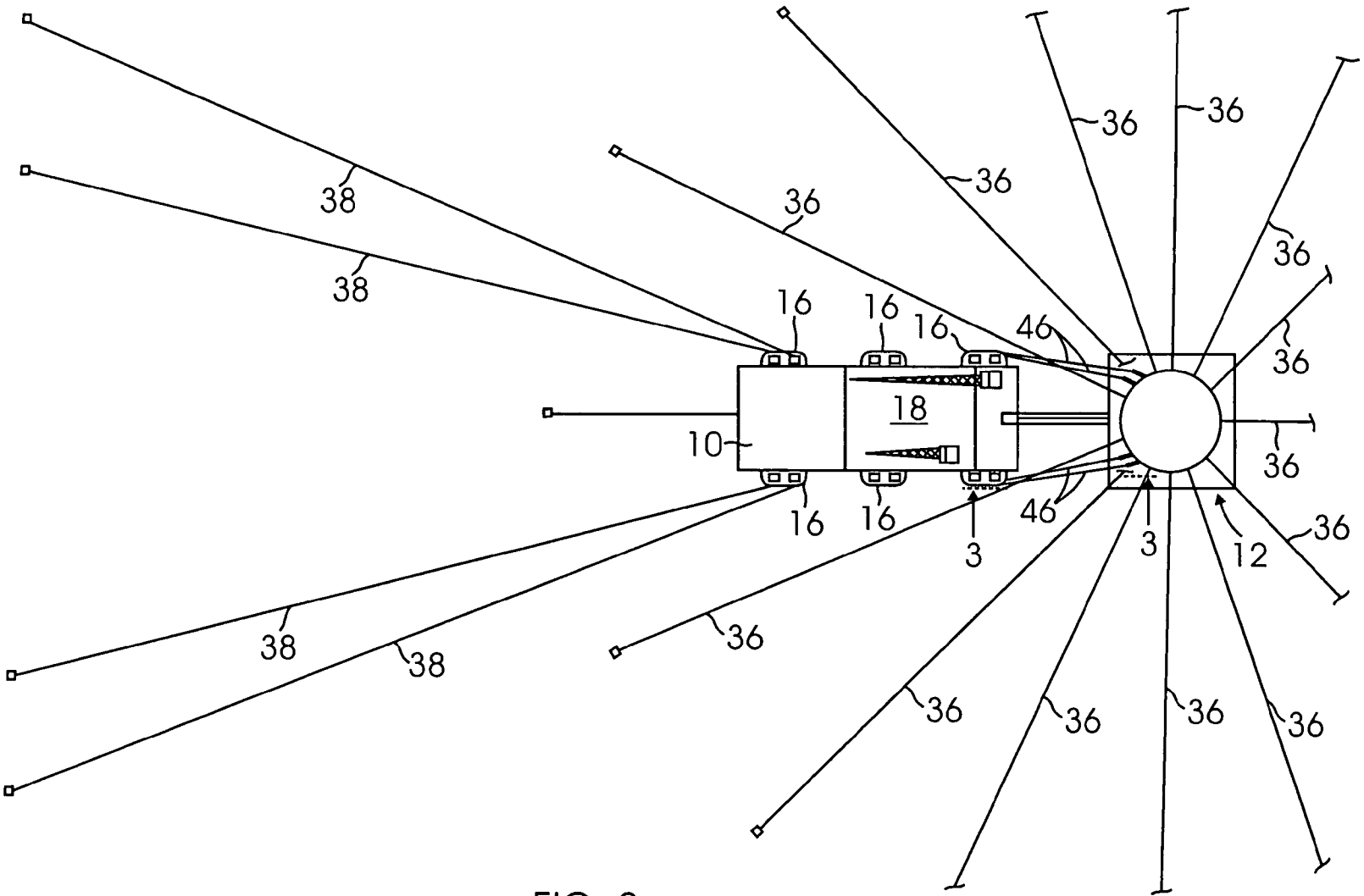
FIG. 2 is a plan view of the TADU and platform of FIG. 1, linked together by the lashing system of the present invention.
Figure 3:
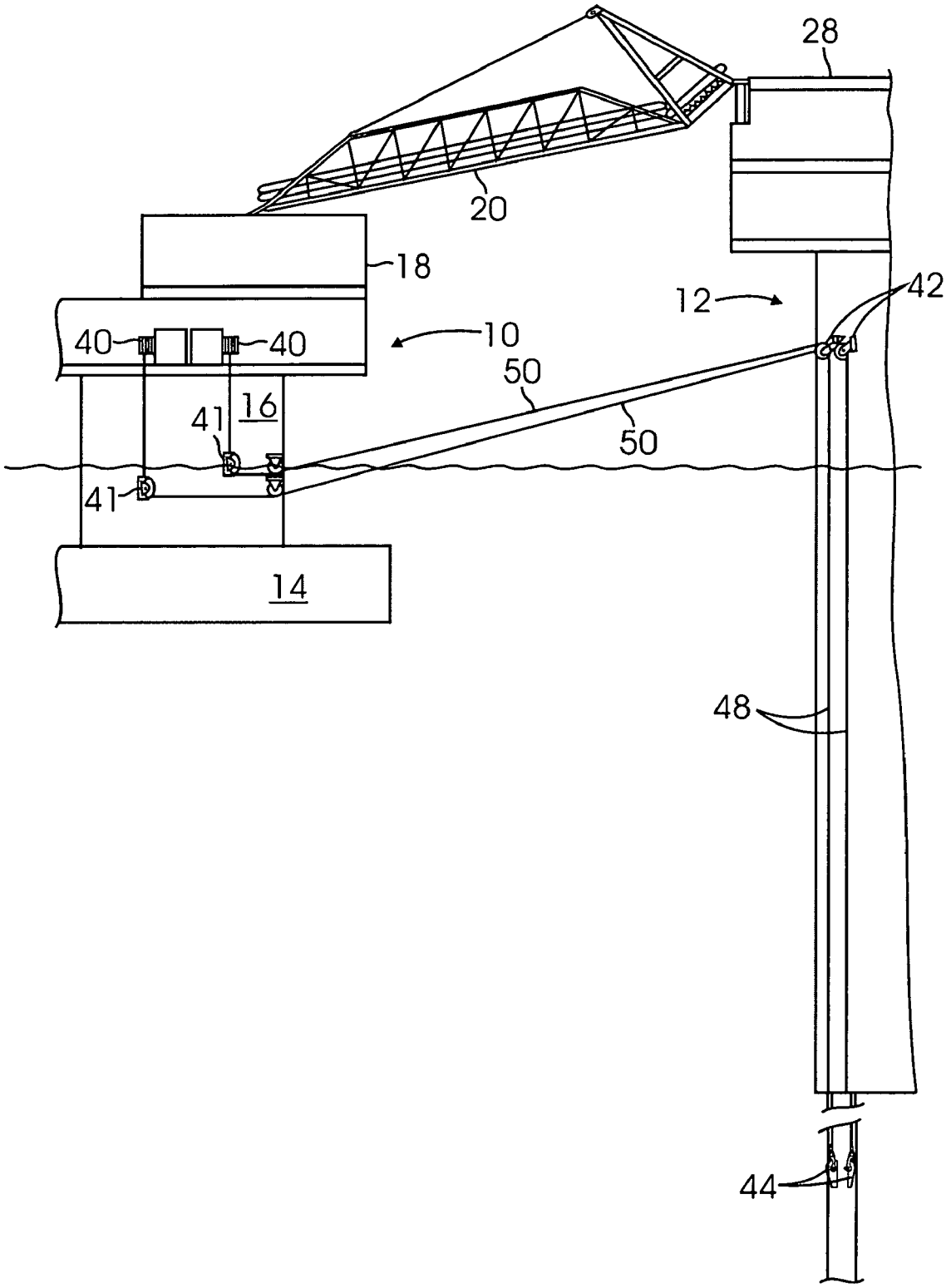
FIG. 3 is a detailed elevational view of the TADU and platform of FIG. 1, taken along line 3-3 of FIG. 2.

Referring now to the drawings, a first floating structure 10 is shown, in FIGS. 1-3, linked to a second floating structure 12 by a lashing system in accordance with a preferred embodiment of the present invention. In this exemplary embodiment, the first floating structure 10 is a tender assist drilling unit (TADU), and will be referred to as such in the following description. The second floating structure 12 is an offshore drilling and production platform of the truss spar type, and will be referred to as a "platform" in the following description. It should be understood, however, that the present invention is not limited to use with the specific types of floating structures described herein. For example, the second floating structure 12 can be a classic spar platform, a cell spar platform, or any other platform or structure having a relatively deep draft hull supporting a deck structure. Similarly, the first floating structure 10 can be any type of floating structure that needs to be linked or lashed to another floating structure, such as a platform.

As shown, the TADU 10 includes a hull that has a submerged portion 14, from which extend a plurality of columns 16 that support a deck 18 on which various equipment and structures used in drilling and production operations are located. Also secured to the deck 18 is a gangway 20 having a distal end adapted to be secured to the platform when the structures 10, 12 are lashed together by the present invention, as will be described below.

Assuming for the sake of this description that the platform 12 is a truss spar platform, the platform 12 has a hull comprising a buoyant hard tank 22, a truss structure 24, extending from the bottom of the hard tank 22, and a variable-buoyancy soft tank 26 fixed to the bottom of the truss structure 24. A deck 28 is secured to the top of the hard tank 22, supported above the surface of the water, and it is adapted to receive and secure the distal end of the gangway 20 when the structures 10, 12 are lashed together by the present invention. The truss structure 24 comprises a plurality of vertical truss members 30 and cross-braces 32. The truss structure 24 advantageously includes a plurality of horizontal heave plates 34 secured to the vertical members 30, as is well-known in the art.

As best shown in FIGS. 1 and 2, the platform 12 is secured to the seabed (not shown) by a plurality of platform mooring lines 36. Similarly, the TADU 10 is secured to the seabed, at a location closely adjacent to the platform 12, by a plurality of TADU mooring lines 38 secured to its aft end, after having been moved to that location, either under its own power (if self-propelled), or by tugboats (not shown).

A plurality of winches 40 is provided near the forward end of the TADU 10, preferably on the two forward-most columns 16 of the TADU hull. In a preferred embodiment, each of the two forward-most columns 16 carries two winches 40, for a total of four winches 40. Mounted on the forward-most columns 16 below each of the winches 40 is winch sheave 41. A like plurality of idler sheaves or pulleys 42 is mounted on the upper part of the platform hull, such as on the hard tank 22, on the side that would be lashed to the TADU 10. Thus, as shown in FIG. 2, in the exemplary embodiment disclosed herein, there are four idler sheaves 42, two at approximately the 4 o'clock position and two at approximately the 8 o'clock position on the hard tank 22 (looking from the TADU 10). It may be advantageous to provide idler sheaves at the 2 o'clock and 10 o'clock positions as well, to allow the TADU 10 to be lashed to either side of the platform 12. For each winch 40 and idler sheave 42, there is a padeye connection 44 mounted on the lower portion of the platform hull, above the soft tank 26. In the exemplary embodiment disclosed herein, each of the padeye connections 44 is fixed to a vertical truss member 30 a short distance above its juncture with the soft tank 26.

Figure 4:
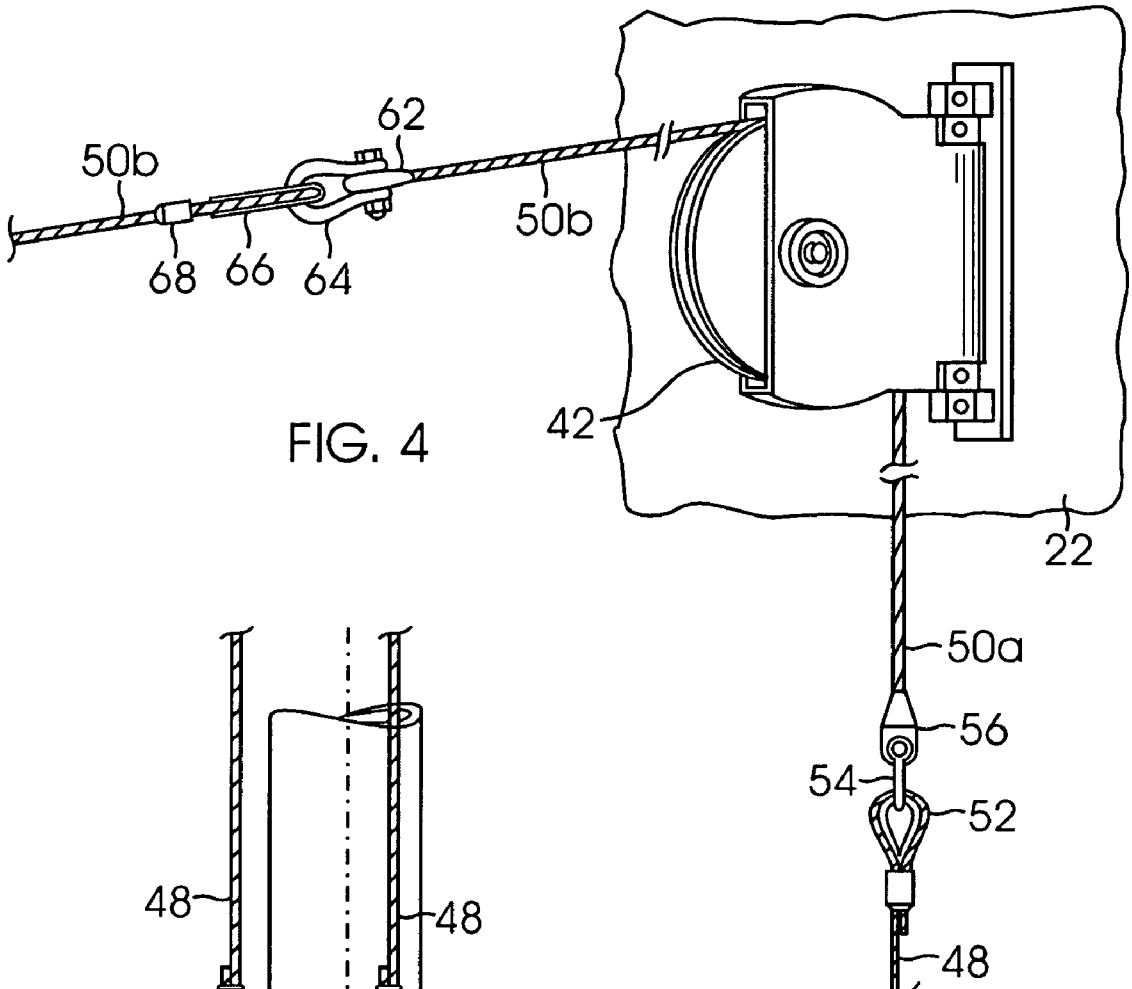
FIG. 4 is a detailed elevational view of the upper portion of one of the hawser assemblies used in the lashing system of the present invention, showing the three major parts of the hawser assembly and a sheave through which the sheave portion of the hawser assembly is run.
Figure 5:
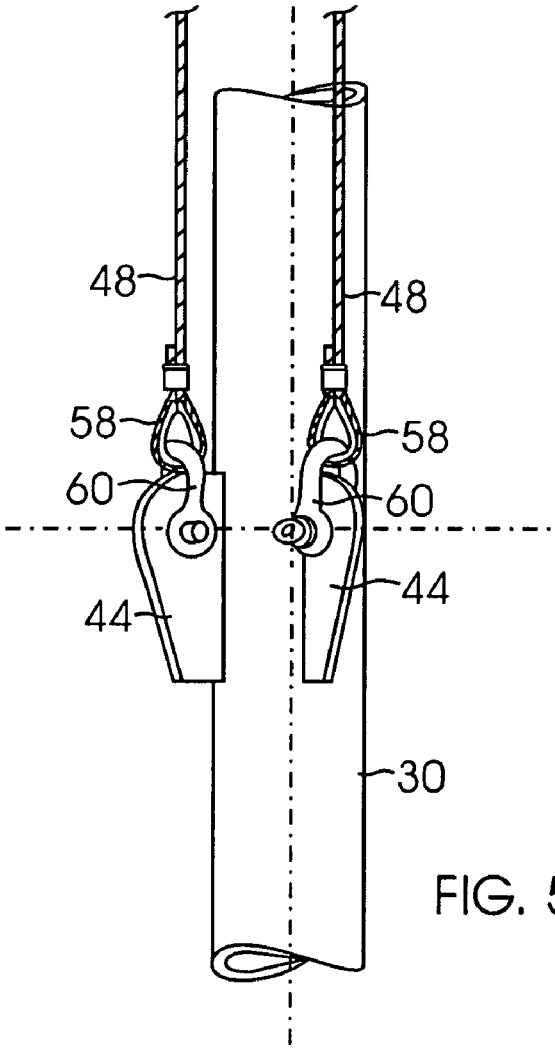
FIG. 5 is a detailed elevational view of the portion of the hawser assemblies enclosed within the dashed outline 5 in FIG. 1, showing the connection between the hawsers and the hull by means of a padeye connection.

A plurality of lashing lines 46 are employed to lash the TADU 10 to the platform 12 by means of the winches 40, idler sheaves 42, and padeye connections 44. As best shown in FIGS. 4 and 5, each lashing line 46 comprises a long length of flexible hawser 48 and a winch cable 50. The hawser 48 is preferably made of nylon or an equivalent polymer that has some degree of elasticity. In an exemplary embodiment, the hawser 48 has a diameter of about 12.7 cm, and it has a first or upper end terminating in a first or upper eyelet 52 that is connected, by means such as a first shackle 54, to a first socket 56 at the free end of the winch cable 50. The hawser 48 extends vertically down the side of the platform and that terminates in a second or lower eyelet 58 that is secured, by means such as a subsea mooring connector 60, to one of the padeye connections 44.

The winch cable 50 is preferably a wire rope cable, of about 7.6 cm diameter, and it advantageously comprises a first cable section **50*a* and a second cable section 50*b*, connected end-to-end. The first cable section 50*a* includes the free end that terminates in the first socket 56 to which the hawser 48 is attached. The first cable section 50*a* passes through the idler sheave 42 and terminates in a second end that is connected to a first end of the second cable section 50*b* by means such as a second socket 62, a third shackle 64, a pear link 66, and a third socket 68 that terminates a first end of the second cable section 50***b*. The second cable section 50*b* extends to one of the winches 40 on the TADU 10, on which it is wound to be reeled in and paid out as necessary to bring the two structures 10, 12 to their desired separation distance, to maintain that distance during operations, and to increase the separation distance in extreme environmental conditions.

In operation, the TADU 10 is brought to the vicinity of the moored platform 12, as mentioned above. At least one of the winch cables 50 is assembled by connecting the first cable section 50*a* to the second cable section 50*b* (which is installed on one of the winches 40) by a connection mechanism such as that described above. This can be done on an anchor handling tug or "AHT" (not shown). The TADU 10 is brought to the desired separation distance from the platform 12 and moored by means of the TADU mooring lines 38. Each assembled winch cable 50 is run through its associated idler sheave 42 on the platform 12, and then has its free end connected to the upper eyelet 52 of the hawser 48, by a connection means such as the first socket 56 and the first shackle 54 described above. The remaining winch cables 50 may be assembled, run through their respective sheaves 42, and attached to their respective hawsers 48 at this point as well. Finally, each of the hawsers 48 is secured at its lower end to its associated padeye connection 44 by means such as the lower eyelet 58 and the subsea mooring connector 60, as described above.

With the lashing lines 46 thus assembled and secured between the TADU 10 and the platform 12, the winches 40 can be employed to adjust and control the separation distance between the two floating structures to maintain the optimum separation distance, which would typically be the optimum distance for securing distal end of the gangway 20 to its appropriate attachment fixture or location on the platform 12. The hawsers 48, being made of a material, such as nylon, that is somewhat elastic, provide a degree of stretching that absorbs relative motions between the floating structures 10, 12 caused by the environment, while keeping the two structures at an optimum desired operating distance, typically a minimum of about 10 meters in ordinary environmental conditions. Due to the limited space between the TADU 10 and the platform 12, the vertical extension of the hawsers 48 down along the most of the submerged length of the platform 12 provides them with sufficient length to obtain the required "softness" for this lashing application.

The lashing system of the present invention meets a number of significant design criteria. For example, full drilling and production operations can be conducted through a one-year environment, and limited operations can be conducted through a ten-year environment. Moreover, the connection of the gangway 20 can be maintained through a ten-year environment. In more extreme environmental conditions, such as a 100-year storm, the gangway 20 can be disconnected from the platform 12, and the lashing lines 46 paid out to increase the separation distance substantially.

Although an exemplary, preferred embodiment of the invention has been described herein, it will be appreciated that a number of variations and modifications may suggest themselves to those skilled in the pertinent arts. For example, the particular connection mechanisms for connecting the hawsers 48 to the padeyes 44 and to the winch cable 50, and for connecting the first winch cable section 50*a* to the second winch cable section 50*b*, are exemplary only, and suitable alternatives will suggest themselves as equivalents to those skilled in the pertinent arts. Also, the number of lashing lines 46, as well as their particular structure, in terms of the materials and dimensions of the hawsers 48 and the winch cables 50, may be varied considerably for different applications, such as the types of floating structures to be lashed together and the environmental conditions to be endured during their operation. These and other variations and modifications that may suggest themselves should be considered within the spirit and scope of the invention, as defined in the claims that follow.

What is claimed is:

1. A system for lashing first and second floating structures to each other, the second structure having a buoyant hull extending vertically from an upper portion to a lower portion, the system comprising:

a plurality of winches on the first structure;

a plurality of sheaves on the upper portion of the hull of the second structure;

a plurality of connection devices on the lower portion of the hull of the second structure; and a set of lashing lines, each of which extends from one of the winches, through a corresponding one of the sheaves, and vertically down the hull of the second structure to a corresponding one of the connection devices to which it is attached.

2. The system of claim 1, wherein the first structure has a forward end separated by a separation distance from the second structure, and wherein the set of lashing lines comprises a set of four lashing lines, each of which extends from one of four winches on the forward end of the first structure, through a corresponding one of the sheaves and vertically down the hull of the second structure to a corresponding one of the connection devices, whereby the winches are operable to control the separation distance.

3. The system of claim 1, wherein the first structure is a tender assist drilling unit (TADU).

4. The system of claim 1, wherein the upper portion of the hull of the second structure includes a buoyant hard tank, wherein the lower portion of the hull of the second structure includes a truss structure, wherein each of the sheaves is fixed to the hard tank, and wherein the connection devices are located on the truss structure.

5. The system of claim 1, wherein each of the lashing lines comprises a flexible hawser connected at a first end to a free end of a winch cable that is wound on one of the winches.

6. The system of claim 5, wherein the flexible hawser is made of a polymer, and wherein the winch cable is a wire rope cable.

7. The system of claim 5, wherein the winch cable comprises first and second sections, connected end-to-end, the first section terminating in the free end to which the hawser is connected, and the second section being wound on, and paid out from, one of the winches.

8. The system of claim 1, wherein the connection devices are subsea mooring connectors.

9. A system for lashing a tender assist drilling unit (TADU) to a floating production platform having an upper hull portion and a lower hull portion, the TADU having a forward end separated from the platform by a separation distance, the system comprising:

a plurality of winches on the forward end of the TADU;

a plurality of sheaves on the upper portion of the hull of the platform;

a plurality of connection devices on the lower portion of the hull of the platform; and a set of lashing lines, each of which extends from one of the winches, through a corresponding one of the sheaves, and vertically down to a corresponding one of the connection devices to which it is attached;

whereby the winches are operable to reel in and to pay out the lashing lines to control the separation distance.

10. The system of claim 9, wherein each of the lashing lines comprises:

a flexible hawser having a lower end connected to one of the connection devices and an upper end;

a winch cable that is wound on one of the winches and that has a free end to which the upper end of the hawser is attached.

11. The system of claim 10, wherein the flexible hawser is made of a polymer, and wherein the winch cable is a wire rope cable.

12. The system of claim 10, wherein the winch cable comprises first and second sections, connected end-to-end, the first section terminating in the free end to which the hawser is connected, and the second section being wound on, and paid out from, one of the winches.

13. The system of claim 9, wherein the connection devices are subsea mooring connectors.

14. A system for lashing a tender assist drilling unit (TADU) having a deck to a floating production platform having an upper hull portion and a lower hull portion, the TADU having a forward end separated from the platform by a separation distance, the system comprising:

a plurality of winches on the forward end of the TADU;

a plurality of sheaves on the upper portion of the hull of the platform;

a plurality of connection devices on the lower portion of the hull of the platform; and a set of lashing lines, each of which extends from one of the winches, through a corresponding one of the sheaves, and vertically down to a corresponding one of the connection devices to which it is attached;

wherein each of the hawsers comprises:

a winch cable wound on one of the winches and through a corresponding one of the sheaves, and having a free end; and a flexible hawser made of a polymer having a degree of elasticity, and having a lower end connected to one of the connection devices and an upper end connected to the free end of the winch cable;

whereby the winches are operable to reel in and to pay out the lashing lines to control the separation distance.

15. The system of claim 14, wherein the flexible hawser is made of nylon, and wherein the winch cable is a wire rope cable.

16. The system of claim 14, wherein the winch cable comprises first and second sections, connected end-to-end, the first section terminating in the free end to which the hawser is connected, and the second section being wound on, and paid out from, one of the winches.

17. The system of claim 14, wherein the connection devices are subsea mooring connectors.

18. A method of coupling a first floating structure having an aft end and a forward end to a second floating structure having a substantially vertical hull with an upper portion and a lower portion, wherein the second structure is secured to the seabed, the method comprising the steps of:

(a) providing a plurality of sheaves on the upper portion of the hull of the second structure and a corresponding plurality of subsea mooring connectors on the lower portion of the hull of the second structure;

(b) bringing the first structure to a desired separation distance between the forward end of the first structure and the second structure;

(c) mooring the aft end of the first structure to the seabed;

(d) extending a plurality of lashing lines from the forward end of the first structure so as to pass each of the plurality of lashing lines through one of the sheaves and to connect each of the plurality of lashing lines to one of the subsea mooring connectors; and (e) varying the length of the lashing lines so as to control the separation distance.

19. The method of claim 18, wherein the steps of extending the plurality of lashing lines and varying the length of the lashing lines are performed by a plurality of winches mounted on the first structure, each of the winches having one of the plurality of lashing lines secured thereto.

20. The method of claim 19, wherein each of the lashing lines comprises a hawser connected to a winch cable, and wherein the step of extending the plurality of lashing lines comprises the steps of:

(d)(1) extending a winch cable from each of the winches and passing each winch cable through a corresponding one of the sheaves, leaving a free end of the winch cable;

(d)(2) attaching a first end of a hawser to the free end of each of the winch cables; and (d)(3) connecting a second end of each of the hawsers to a corresponding one of the subsea mooring connectors.

* * * * *